US005846380A

United States Patent [19]

Van Phan et al.

[11] Patent Number: 5,846,380

[45] **Date of Patent: *Dec. 8, 1998**

[54] CREPED TISSUE PAPER EXHIBITING UNIQUE COMBINATION OF PHYSICAL ATTRIBUTES

[75] Inventors: Dean Van Phan, West Chester; Paul Dennis Trokhan, Hamilton, both of Ohio

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 847,552

[22] Filed: Apr. 23, 1997

Related U.S. Application Data

[63] Continuation of Ser. No. 495,912, Jun. 28, 1995, abandoned.

[51] Int. Cl.[6] ..... D21H 27/38

[52] U.S. Cl. ..... 162/111; 162/112; 162/113; 162/125; 162/127; 162/129; 162/130; 162/158; 162/164.1; 162/164.3; 162/168.1; 162/168.2; 162/175

[58] Field of Search ..... 162/111, 112, 162/113, 158, 164.1, 175, 164.31, 64.6, 168.11, 168.2, 168.3, 123, 127; 161/125, 129, 130; 428/153, 154

[56] References Cited

U.S. PATENT DOCUMENTS

| | | | |
|---|---|---|---|
| 2,683,087 | 7/1954 | Reynolds, Jr. | 162/158 |
| 2,683,088 | 7/1954 | Reynolds, Jr. | 162/158 |
| 3,301,746 | 1/1967 | Sanford et al. | 162/113 |
| 3,554,863 | 1/1971 | Hervey et al. | 162/158 |
| 3,755,220 | 8/1973 | Freimark et al. | 260/17.3 |
| 3,844,880 | 10/1974 | Meisel, Jr. et al. | 162/169 |
| 3,974,025 | 8/1976 | Ayers | 162/113 |
| 3,994,771 | 11/1976 | Morgan, Jr. et al. | 162/113 |
| 4,144,122 | 3/1979 | Emanuelsson et al. | 162/158 |
| 4,191,609 | 3/1980 | Trokhan | 162/113 |
| 4,300,981 | 11/1981 | Carstens | 162/109 |
| 4,351,699 | 9/1982 | Osborn, III | 162/112 |
| 4,377,543 | 3/1983 | Strohbeen et al. | 264/120 |
| 4,441,962 | 4/1984 | Osborn, III | 162/111 |
| 4,447,294 | 5/1984 | Osborn, III | 162/158 |
| 4,529,480 | 7/1985 | Trokhan | 162/109 |
| 4,637,859 | 1/1987 | Trokhan | 162/109 |
| 4,795,530 | 1/1989 | Soerens et al. | 162/111 |
| 4,940,513 | 7/1990 | Spendel | 162/112 |
| 4,950,545 | 8/1990 | Walter et al. | 428/446 |
| 4,959,125 | 9/1990 | Spendel | 162/158 |
| 5,059,282 | 10/1991 | Ampulski et al. | 162/111 |
| 5,164,046 | 11/1992 | Ampulski et al. | 162/111 |
| 5,215,626 | 6/1993 | Ampulski et al. | 162/112 |
| 5,217,576 | 6/1993 | Phan | 162/158 |
| 5,223,096 | 6/1993 | Phan et al. | 162/158 |
| 5,227,242 | 7/1993 | Walter et al. | 428/446 |
| 5,240,562 | 8/1993 | Phan et al. | 162/158 |
| 5,246,545 | 9/1993 | Ampulski et al. | 162/112 |
| 5,246,546 | 9/1993 | Ampulski | 162/112 |
| 5,262,007 | 11/1993 | Phan et al. | 162/158 |
| 5,264,082 | 11/1993 | Phan et al. | 162/158 |
| 5,279,767 | 1/1994 | Phan et al. | 252/357 |
| 5,312,522 | 5/1994 | Phan et al. | 162/111 |
| 5,397,435 | 3/1995 | Ostendorf et al. | 162/112 |
| 5,405,501 | 4/1995 | Phan et al. | 162/127 |
| 5,415,737 | 5/1995 | Phan et al. | 162/111 |
| 5,427,696 | 6/1995 | Phan et al. | 252/8.6 |
| 5,437,766 | 8/1995 | Phan et al. | 162/127 |
| 5,487,813 | 1/1996 | Vinson et al. | 162/111 |

FOREIGN PATENT DOCUMENTS

| | | |
|---|---|---|
| Sho 61-308312 | 7/1988 | Japan . |
| 4-100995 | 4/1992 | Japan . |

OTHER PUBLICATIONS

"Applications of Armak Quaternary Ammonium Salts", Bulletin 76–17, Armak Co., (1977).

*Primary Examiner*—Peter Chin
*Attorney, Agent, or Firm*—Edward J. Milbrada; Bart S. Hersko; E. Kelly Linman

[57] ABSTRACT

A soft absorbent, creped tissue paper having an ATP factor of less than about 0.036, a slip/stick coefficient of less than about 0.024, and a lint level of less than about 6. The tissue paper preferably has a density of less than about 0.15 gram/cm$^3$. Preferably, the creped tissue paper is a single- or multi-layer, single-ply tissue. More preferably, the creped tissue paper is made by a through air drying technique. Tissue paper having unique combinations of these above attributes is highly desirable by the consumers.

24 Claims, 2 Drawing Sheets

CREPED TISSUE PAPER EXHIBITING UNIQUE COMBINATION OF PHYSICAL ATTRIBUTES

This is a continuation of application Ser. No. 08/495,912, filed on Jun. 28, 1995 now abandoned.

FIELD OF THE INVENTION

This invention relates to tissue paper products. More particularly, it relates to tissue paper products exhibiting a unique combination of physical attributes such as ATP factor, slip/stick coefficient and lint. The tissue paper can be used to make soft, absorbent and lint resistant paper products such as facial tissue paper products or toilet tissue paper products.

BACKGROUND OF THE INVENTION

Paper webs or sheets, sometimes called tissue or paper tissue webs or sheets, find extensive use in modern society. Such items as facial and toilet tissues are staple items of commerce. It has long been recognized that four important physical attributes of these products are their strength, their softness, their absorbency, including their absorbency for aqueous systems; and their lint resistance, including their lint resistance when wet. Research and development efforts have been directed to the improvement of each of these attributes without seriously affecting the others as well as to the improvement of two or three attributes simultaneously.

Strength is the ability of the product, and its constituent webs, to maintain physical integrity and to resist tearing, bursting, and shredding under use conditions, particularly when wet.

Softness is the tactile sensation perceived by the consumer as he/she holds a particular product, rubs it across his/her skin, or crumples it within his/her hand. This tactile sensation is provided by a combination of several physical properties. Important physical properties related to softness are generally considered by those skilled in the art to be the stiffness, the surface smoothness and lubricity of the paper web from which the product is made. Stiffness, in turn, is usually considered to be directly dependent on the dry tensile strength of the web and the stiffness of the fibers which make up the web.

Absorbency is the measure of the ability of a product, and its constituent webs, to absorb quantities of liquid, particularly aqueous solutions or dispersions. Overall absorbency as perceived by the consumer is generally considered to be a combination of the total quantity of liquid a given mass of tissue paper will absorb at saturation as well as the rate at which the mass absorbs the liquid.

Lint resistance is the ability of the fibrous product, and its constituent webs, to bind together under use conditions, including when wet. In other words, the higher the lint resistance is, the lower the propensity of the web to lint will be.

The use of wet strength resins to enhance the strength of a paper web is widely known. For example, Westfelt described a number of such materials and discussed their chemistry in Cellulose Chemistry and Technology, Volume 13, at pages 813–825 (1979). Freimark et al. in U.S. Pat. No. 3,755,220 issued Aug. 28, 1973 mention that certain chemical additives known as debonding agents interfere with the natural fiber-to-fiber bonding that occurs during sheet formation in paper making processes. This reduction in bonding leads to a softer, or less harsh, sheet of paper. Freimark et al. go on to teach the use of wet strength resins in conjunction with the use of debonding agents to off-set the undesirable effects of the debonding agents. These debonding agents do reduce both dry tensile strength and wet tensile strength.

Shaw, in U.S. Pat. No. 3,821,068, issued Jun. 28, 1974, also teaches that chemical debonders can be used to reduce the stiffness, and thus enhance the softness, of a tissue paper web.

Chemical debonding agents have been disclosed in various references such as U.S. Pat. No. 3,554,862, issued to Hervey et al. on Jan. 12, 1971. These materials include quaternary ammonium salts such as cocotrimethylammonium chloride, oleyltrimethylammonium chloride, di(hydrogenated)tallow dimethyl ammonium chloride and stearyltrimethyl ammonium chloride.

Emanuelsson et al., in U.S. Pat. No. 4,144,122, issued Mar. 13, 1979, and Hellsten et al., in U.S. Pat. No. 4,476,323, issued Oct. 9, 1984, teach the use of complex quaternary ammonium compounds such as bis(alkoxy(2-hydroxy) propylene) quaternary ammonium chlorides to soften webs. These authors also attempt to overcome any decrease in absorbency caused by the debonders through the use of nonionic surfactants such as ethylene oxide and propylene oxide adducts of fatty alcohols.

Armak Company, of Chicago, Ill., in their bulletin 76-17 (1977) disclose the use of dimethyl di(hydrogenated)tallow ammonium chloride in combination with fatty acid esters of polyoxyethylene glycols to impart both softness and absorbency to tissue paper webs.

One exemplary result of research directed toward improved paper webs is described in U.S. Pat. No. 3,301,746, issued to Sanford and Sisson on Jan. 31, 1967. Despite the high quality of paper webs made by the process described in this patent, and despite the commercial success of products formed from these webs, research efforts directed to finding improved products have continued.

For example, Becker et al. in U.S. Pat. No. 4,158,594, issued Jan. 19, 1979, describe a method they contend will form a strong, soft, fibrous sheet. More specifically, they teach that the strength of a tissue paper web (which may have been softened by the addition of chemical debonding agents) can be enhanced by adhering, during processing, one surface of the web to a creping surface in a fine patterned arrangement by a bonding material (such as an acrylic latex rubber emulsion, a water soluble resin, or an elastomeric bonding material) which has been adhered to one surface of the web and to the creping surface in the fine patterned arrangement, and creping the web from the creping surface to form a sheet material.

The present invention is applicable to tissue paper in general, but also applicable to single-ply, multi-layered tissue paper products such as those described in U.S. Pat. No. 3,994,771, issued to Morgan Jr. et al. on Nov. 30, 1976, and in U.S. Pat. No. 4,300,981, Carstens, issued Nov. 17, 1981, both of which are incorporated herein by reference. These techniques enhance tissue softness by increasing the lint. The thin beam of the long softwood fiber layer provides the high tensile strength at relatively low flexural modulus. However, the smooth tactile of the layered tissue is created by the unbonded eucalyptus fiber layers with a trade-off in lint level compared to the homogenous tissue.

The present invention enhances tissue softness by reducing the dissipation energy levels (e.g., reducing the slip/stick coefficient, enhancing the structural flexibility etc. . . . ) at low lint levels of the fibrous structure. Tissue paper having unique combinations of these above attributes is highly desirable by the consumers. The tissue paper prepared by this invention can be used to make soft, absorbent and lint resistant paper products such as facial tissue paper products or toilet tissue paper products.

It is an object of this invention to provide soft, absorbent and lint resistant tissue paper products.

It is also a further object of this invention to provide a process for making soft, absorbent, lint resistant tissue paper products.

These and other objects are obtained using the present invention, as will become readily apparent from a reading of the following disclosure.

SUMMARY OF THE INVENTION

This invention relates to creped tissue paper products. In particular, creped tissue paper exhibiting a unique combination of physical attributes such as ATP factor, slip/stick coefficient and lint. Especially, soft absorbent, creped tissue paper having an ATP factor of less than about 0.036, a slip/stick coefficient of less than about 0.024, and a lint level of less than about 6. Tissue paper having unique combinations of these above attributes is highly desirable by the consumers.

As will be discussed in detail hereinafter, the slip/stick coefficient relates to the perceived surface tactile feel. The ATP factor correlates to the flexibility of the fibrous substrate. The lint level is a measure of the propensity of the tissue paper to lint.

Tissue paper of the present invention having the unique combination of these attributes (ATP factor, slip/stick coefficient, and lint level) is highly desirable by the consumers. Importantly, the present invention provides a tissue paper that has an unique combination of these attributes, and thus offers significant improvements over previous tissue paper products. In particular, the tissue paper of the present invention exhibits an herein before unachievable combination of softness and strength at low lint levels. Without being bound by theory, it is believed that the present invention enhances tissue softness by reducing the dissipation energy levels (e.g., reducing the slip/stick coefficient, and enhancing the structural flexibility etc. . . . ) at low lint levels of the fibrous structure.

Without limiting the scope of the present invention, and for exemplary purposes only, one way to achieve this unique combination of attributes is as follows: A chemical debonding agent (e.g., a quaternary ammonium compound, etc.) that acts to debond the fiber-to-fiber hydrogen bonds and improve the paper's ATP factor is added to the tissue sheet. In multi-layered products, preferably the center layer is completely debonded. Alternatively, a surface modifying agent (e.g., a polysiloxane compound) that enhances the slip/stick coefficient can be added to the outer layers of the tissue sheet. Polyhydroxy compounds (e.g., glycerol, polyoxyethylene etc. . . . ) can be used to improve the flexibility of the tissue substrate. A long chain polymer (i.e., a wet and/or dry strength binder) can also be introduced to the tissue sheet to offset any deleterious effects on the strength and/or linting that may be caused by addition of the chemical debonding agent. Additional strength can also be generated by refining the papermaking fibers and/or increasing the surface bonded areas of the fibers. A more detailed description of preferred methods for making the unique tissue paper of the present invention, complete with examples, is provided hereinafter.

The tissue paper prepared by this invention can be used to make soft, absorbent and lint resistant paper products such as facial tissue paper products or toilet tissue paper products.

Figure 1:
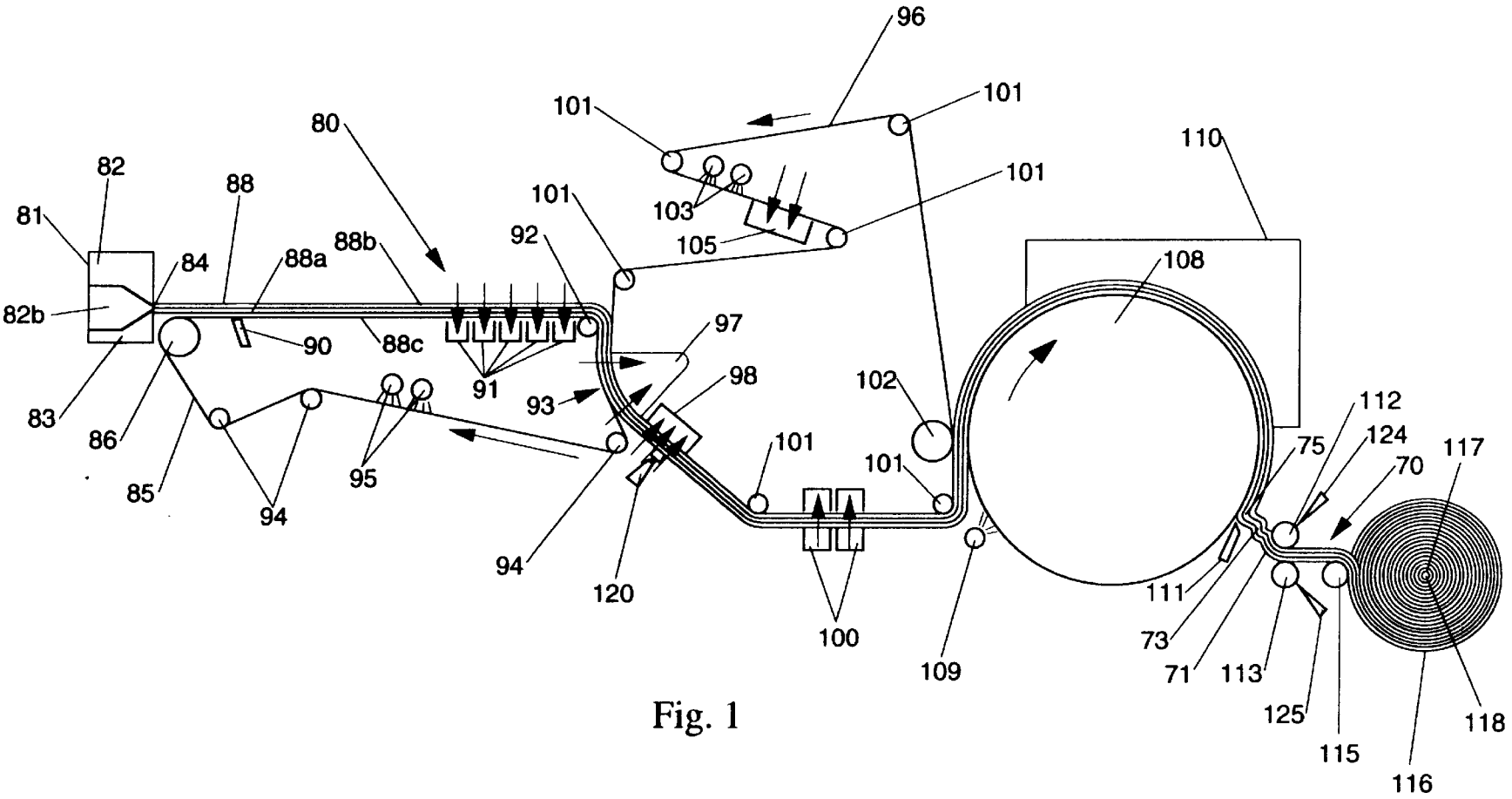
FIG. 1 is a schematic representation illustrating a preferred embodiment of the papermaking process of the present invention for producing a strong and soft creped tissue paper using a through air drying technique.

The present invention is described in more detail below.

DETAILED DESCRIPTION OF THE INVENTION

While this specification concludes with claims particularly pointing out and distinctly claiming the subject matter regarded as the invention, it is believed that the invention can be better understood from a reading of the following detailed description and of the appended examples.

As used herein, the term "lint resistance" is the ability of the fibrous product, and its constituent webs, to bind together under use conditions, including when wet. In other words, the higher the lint resistance is, the lower the propensity of the web to lint will be.

As used herein, the term "binder" refers to the various wet and dry strength resins and retention aid resins known in the paper making art.

As used herein, the term "water soluble" refers to materials that are soluble in water to at least 3% at 25° C.

As used herein, the terms "tissue paper web, paper web, web, paper sheet and paper product" all refer to sheets of paper made by a process comprising the steps of forming an aqueous paper making furnish, depositing this furnish on a foraminous surface, such as a Fourdrinier wire, and removing the water from the furnish as by gravity or vacuum-assisted drainage, with or without pressing, and by evaporation.

As used herein, an "aqueous paper making furnish" is an aqueous slurry of paper making fibers and the chemicals described hereinafter.

As used herein, the term "multi-layered tissue paper web, multi-layered paper web, multi-layered web, multi-layered paper sheet and multi-layered paper product" all refer to sheets of paper prepared from two or more layers of aqueous paper making furnish which are preferably comprised of different fiber types, the fibers typically being relatively long softwood and relatively short hardwood fibers as used in tissue paper making. The layers are preferably formed from the deposition of separate streams of dilute fiber slurries, upon one or more endless foraminous screens. If the individual layers are initially formed on separate wires, the layers are subsequently combined (while wet) to form a layered composite web.

As used herein the term "multi-ply tissue paper product" refers to a tissue paper consisting of at least two plies. Each individual ply in turn can consist of single-layered or multi-layered tissue paper webs. The multi-ply structures are formed by bonding together two or more tissue webs such as by glueing or embossing.

As used herein the term "through air drying" technique refers to a technique of drying the web by hot air.

As used herein the term "mechanical dewatering" technique refers to a technique of drying the web by mechanical pressing with a dewatering felt.

It is anticipated that wood pulp in all its varieties will normally comprise the paper making fibers used in this invention. However, other cellulose fibrous pulps, such as cotton liners, bagasse, rayon, etc., can be used and none are disclaimed. Wood pulps useful herein include chemical pulps such as Kraft, sulfite and sulfate pulps as well as mechanical pulps including for example, ground wood, thermomechanical pulps and Chemi-ThermoMechanical Pulp (CTMP). Pulps derived from both deciduous and coniferous trees can be used.

Synthetic fibers such as rayon, polyethylene and polypropylene fibers, may also be utilized in combination with the above-identified natural celluose fibers. One exemplary polyethylene fiber which may be utilized is Pulpex®, available from Hercules, Inc. (Wilmington, Del.).

Both hardwood pulps and softwood pulps as well as blends of the two may be employed. The terms hardwood pulps as used herein refers to fibrous pulp derived from the woody substance of deciduous trees (angiosperms): wherein softwood pulps are fibrous pulps derived from the woody substance of coniferous trees (gymnosperms). Hardwood pulps such as eucalyptus are particularity suitable for the outer layers of the multi-layered tissue webs described hereinafter, whereas northern softwood Kraft pulps are preferrred for the inner layer(s) or ply(s). Also applicable to the present invention are low cost fibers derived from recycled paper, which may contain any or all of the above categories as well as other non-fibrous materials such as fillers and adhesives used to facilitate the original paper making.

This invention relates to creped tissue paper products. In particularly, creped tissue paper exhibiting a unique combination of physical attributes such as ATP factor, slip/stick coefficient and lint. Preferably, a soft absorbent, creped tissue paper having a ATP factor of less than about 0.036, a slip/stick coefficient of less than about 0.024, and a lint level of less than about 6. More preferably, a soft absorbent, creped tissue paper having a ATP factor of less than about 0.030, a slip/stick coefficient of less than about 0.022, and a lint level of less than about 5. Tissue paper having unique combinations of these above attributes is highly desirable by the consumers. The tissue paper prepared by this invention can be used to make soft, absorbent and lint resistant paper products such as facial tissue paper products or toilet tissue paper products.

The present invention is applicable to tissue paper in general, including but not limited to conventionally felt-pressed tissue paper; high bulk pattern densified tissue paper; and high bulk, uncompacted tissue paper. The tissue paper products made therefrom may be of a single-layered or multi-layered construction. Tissue structures formed from layered paper webs are described in U.S. Pat. No. 3,994,771, Morgan, Jr. et al. issued Nov. 30, 1976, U.S. Pat. No. 4,300,981, Carstens, issued Nov. 17, 1981, U.S. Pat. No. 4,166,001, Dunning et al., issued Aug. 28, 1979, and European Patent Publication No. 0 613 979 A1, Edwards et al., published Sep. 7, 1994, all of which are incorporated herein by reference. In general, a wet-laid composite, soft, bulky and absorbent paper structure is prepared from two or more layers of furnish which are preferably comprised of different fiber types. The layers are preferably formed from the deposition of separate streams of dilute fiber slurries, the fibers typically being relatively long softwood and relatively short hardwood fibers as used in multi-layered tissue paper making, upon one or more endless foraminous screens. If the individual layers are initially formed on separate wires, the layers are subsequently combined (while wet) to form a layered composite web. The layered web is subsequently caused to conform to the surface of an open mesh drying/imprinting fabric by the application of a fluid force to the web and thereafter thermally predried on said fabric as part of a low density paper making process. The web may be stratified with respect to fiber type or the fiber content of the respective layers may be essentially the same. The multi-layered tissue paper preferably has a basis weight of between 10 g/m$^2$ and about 65 g/m$^2$, and density of about 0.60 g/cm$^3$ or less. Preferably, basis weight will be below about 35 g/m$^2$ or less; and density will be about 0.30 g/cm$^3$ or less. Most preferably, density will be between 0.04 g/cm$^3$ and about 0.15 g/cm$^3$.

In a preferred embodiment of this invention, tissue structures are formed from multi-layered paper webs as described in U.S. Pat. No. 4,300,981, Carstens, issued Nov. 17, 1981 and incorporated herein by reference. According to Carstens, such paper has a high degree of subjectively perceivable softness by virtue of being: multi-layered; having a top surface layer comprising at least about 60% and preferable about 85% or more of short hardwood fibers; having an HTR (Human Texture Response)-Texture of the top surface layer of about 1.0 or less, and more preferably about 0.7 or less, and most preferably about 0.1 or less; having an FFE (Free Fiber End)-Index of the top surface of about 60 or more, and preferably about 90 or more. The process for making such paper includes the step of breaking sufficient interfiber bonds between the short hardwood fibers defining its top surface to provide sufficient free end portions thereof to achieve the required FFE-Index of the top surface of the tissue paper. Such bond breaking is achieved by dry creping the tissue paper from a creping surface to which the top surface layer (short fiber layer) has been adhesive secured, and the creping should be affected at a consistency (dryness) of at least about 80% and preferably at least about 95% consistency. Such tissue paper may be made through the use of conventional felts, or foraminous carrier fabrics. Such tissue paper may be but is not necessarily of relatively high bulk density. Preferably, the tissue paper is made by through air drying technique as described herein after.

The individual plies contained in the tissue paper products of the present invention preferably comprise at least two superposed layers, an inner layer and an outer layer contiguous with the inner layer. The outer layers preferably comprise a primary filamentary constituent of about 60% or more by weight of relatively short paper making fibers having an average fiber between about 0.2 mm and about 1.5 mm. These short paper making fibers are typically hardwood fibers, preferably, eucalyptus fibers. Alternatively, low cost sources of short fibers such as sulfite fibers, thermomechanical pulp, Chemi-ThermoMechanical Pulp (CTMP) fibers, recycled fibers, and mixtures thereof can be used in the outer layers or blended in the inner layer, if desired. The inner layer preferably comprises a primary filamentary constituent of about 60% or more by weight of relatively long paper making fibers having an average fiber length of least about 2.0 mm. These long paper making fibers are typically softwood fibers, preferably, northern softwood Kraft fibers.

Conventionally pressed multi-layered tissue paper and methods for making such paper are known in the art. Such paper is typically made by depositing paper making furnish on a foraminous forming wire. This forming wire is often referred to in the art as a Fourdrinier wire. Once the furnish is deposited on the forming wire, it is referred to as a web. The web is dewatered by transferring to a dewatering felt, pressing the web and drying at elevated temperature. This technique of drying the web by mechanical pressing with a dewatering felt is referred to herein as mechanical dewatering technique. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 25% (total web weight basis) by vacuum dewatering and further dewatered by pressing operations wherein the web is subjected to pressure developed by opposing mechanical members, for example, cylindrical rolls.

The dewatered web is then further pressed during transfer and is dried by a stream drum apparatus known in the art as a Yankee dryer. Pressure can be developed at the Yankee dryer by mechanical means such as an opposing cylindrical drum pressing against the web. Vacuum may also be applied to the web as it is pressed against the Yankee surface. Multiple Yankee dryer drums may be employed, whereby additional pressing is optionally incurred between the drums. The multi-layered tissue paper structures which are formed are referred to hereinafter as conventional, pressed, multi-layered tissue paper structures. Such sheets are considered to be compacted since the entire web is subjected to substantial mechanical compression forces while the fibers are moist and are then dried while in a compressed state.

Pattern densified tissue paper is characterized by having a relatively high bulk field of relatively low fiber density and an array of densified zones of relatively high fiber density. The high bulk field is alternatively characterized as a field of pillow regions. The densified zones are alternatively referred to as knuckle regions. The densified zones may be discretely spaced within the high bulk field or may be interconnected, either fully or partially, within the high bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayers on Aug. 10, 1976, and U.S. Pat. No. 4,191,609, issued to Paul D. Trokhan on Mar. 4, 1980, and U.S. Pat. No. 4,637,859, issued to Paul D. Trokhan on Jan. 20, 1987, U.S. Pat. No. 4,942,077 issued to Wendt et al. on Jul. 17, 1990, European Patent Publication No. 0 617 164 A1, Hyland et al., published Sep. 28, 1994, European Patent Publication No. 0 616 074 A1, Hermans et al., published Sep. 21, 1994; all of which are incorporated herein by reference.

In general, pattern densified webs are preferably prepared by depositing a paper making furnish on a foraminous forming wire such as a Fourdrinier wire to form a wet web and then juxtaposing the web against an array of supports. The web is pressed against the array of supports, thereby resulting in densified zones in the web at the locations geographically corresponding to the points of contact between the array of supports and the wet web. The remainder of the web not compressed during this operation is referred to as the high bulk field. This high bulk field can be further dedensified by application of fluid pressure, such as with a vacuum type device or a blow-through dryer (e.g., through air drying technique). The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 55% of the multi-layered tissue paper surface comprises densified knuckles having a relative density of at least 125% of the density of the high bulk field.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Friedberg et al., issued Mar. 30, 1971, U.S. Pat. No. 3,473,576, Amneus, issued Oct. 21, 1969, U.S. Pat. No. 4,239,065, Trokhan, issued Dec. 16, 1980, and U.S. Pat. No. 4,528,239, Trokhan, issued Jul. 9, 1985, all of which are incorporated herein by reference.

Preferably, the furnish is first formed into a wet web on a foraminous forming carrier, such as a Fourdrinier wire. The web is dewatered and transferred to an imprinting fabric. The furnish may alternately be initially deposited on a foraminous supporting carrier which also operates as an imprinting fabric. Once formed, the wet web is dewatered and, preferably, thermally predried to a selected fiber consistency of between about 40% and about 80%. Dewatering can be performed with suction boxes or other vacuum devices or with blow-through dryers. Preferably, hot air is forced through the semi-dry web while the semi-dry web is on the forming fabric. This dewatering technique is referred to herein as a through air drying technique. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Uncompacted, nonpattern-densified multi-layered tissue paper structures are described in U.S. Pat. No. 3,812,000 issued to Joseph L. Salvucci, Jr. and Peter N. Yiannos on May 21, 1974 and U.S. Pat. No. 4,208,459, issued to Henry E. Becker, Albert L. McConnell, and Richard Schutte on Jun. 17, 1980, both of which are incorporated herein by reference. In general, uncompacted, non pattern densified multi-layered tissue paper structures are prepared by depositing a paper making furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high bulk sheet of relatively uncompacted fibers. Bonding material is preferably applied to portions of the web prior to creping.

The tissue paper product of this invention can be used in any application where soft, absorbent tissue paper products are required. Particularly advantageous uses of the tissue paper product of this invention are in toilet tissue and facial tissue products.

In the following discussion, wherein reference is made to the several figures, certain preferred embodiments of processes for making the tissue sheet structures of the present invention are described.

FIG. 1 is side elevational view of a preferred papermaking machine 80 for manufacturing paper according to the present invention. Referring to FIG. 1, papermaking machine 80 comprises a layered headbox 81 having a top chamber 82 a center chamber 82*b*, and a bottom chamber 83, a slice roof 84, and a Fourdrinier wire 85 which is looped over and about breast roll 86, deflector 90, vacuum suction boxes 91, couch roll 92, and a plurality of turning rolls 94. In operation, one papermaking furnish is pumped through top chamber 82 a second papermaking furnish is pumped through center chamber 82*b*, while a third furnish is pumped through bottom chamber 83 and thence out of the slice roof 84 in over and under relation onto Fourdrinier wire 85 to form thereon an embryonic web 88 comprising layers 88*a*, and 88*b*, and 88*c*. Dewatering occurs through the Fourdrinier wire 85 and is assisted by deflector 90 and vacuum boxes 91. As the Fourdrinier wire makes its return run in the direction shown by the arrow, showers 95 clean it prior to its commencing another pass over breast roll 86. At web transfer zone 93, the embryonic web 88 is transferred to a foraminous carrier fabric 96 by the action of vacuum transfer box 97. Carrier fabric 96 carries the web from the transfer zone 93 past vacuum dewatering box 98, through blow-through predryers 100 and past two turning rolls 101 after which the web is transferred to a Yankee dryer 108 by the action of pressure roll 102. The carrier fabric 96 is then cleaned and dewatered as it completes its loop by passing over and around additional turning rolls 101, showers 103, and vacuum dewatering box 105. The predried paper web is adhesively secured to the cylindrical surface of Yankee dryer 108 by adhesive applied by spray applicator 109. Drying is completed on the steam heated Yankee dryer 108 and by hot air which is heated and circulated through drying hood 110 by means not shown. The web is then dry creped from the Yankee dryer 108 by doctor blade 111 after which it is designated paper sheet 70 comprising a Yankee-side layer 71 a center layer 73, and an off-Yankee-side layer 75. Paper sheet 70 then passes between calendar rolls 112 and 113, about a circumferential portion of reel 115, and thence is wound into a roll 116 on a core 117 disposed on shaft 118.

Still referring to FIG. 1, the genesis of Yankee-side layer 71 of paper sheet 70 is the furnish pumped through bottom chamber 83 of headbox 81, and which furnish is applied directly to the Fourdrinier wire 85 whereupon it becomes layer 88*c* of embryonic web 88. The genesis of the center layer 73 of paper sheet 70 is the furnish delivered through under chamber 82*b* of headbox 81, and which furnish forms layer 88*b* on top of layer 88*c*. The genesis of the off-Yankee-side layer 75 of paper sheet 70 is the furnish delivered through top chamber 82 of headbox 81, and which furnish forms layer 88*a* on top of layer 88*b* of embryonic web 88. Although FIG. 1 shows papermachine 80 having headbox 81 adapted to make a three-layer web, headbox 81 may alternatively be adapted to make unlayered, two layer or other multi-layer webs. Furthermore the forming section and headbox can be any system suitable for making tissue such as a twin wire former.

Further, with respect to making paper sheet 70 embodying the present invention on papermaking machine 80, FIG. 1, the Fourdrinier wire 85 must be of a fine mesh having relatively small spans with respect to the average lengths of the fibers constituting the short fiber furnish so that good formation will occur; and the foraminous carrier fabric 96 should have a fine mesh having relatively small opening spans with respect to the average lengths of the fibers constituting the long fiber furnish to substantially obviate bulking the fabric side of the embryonic web into the inter-filamentary spaces of the fabric 96. Also, with respect to the process conditions for making exemplary paper sheet 70, the paper web is preferably dried to about 80% fiber consistency, and more preferably to about 95% fiber consistency prior to creping.

Figure 2:
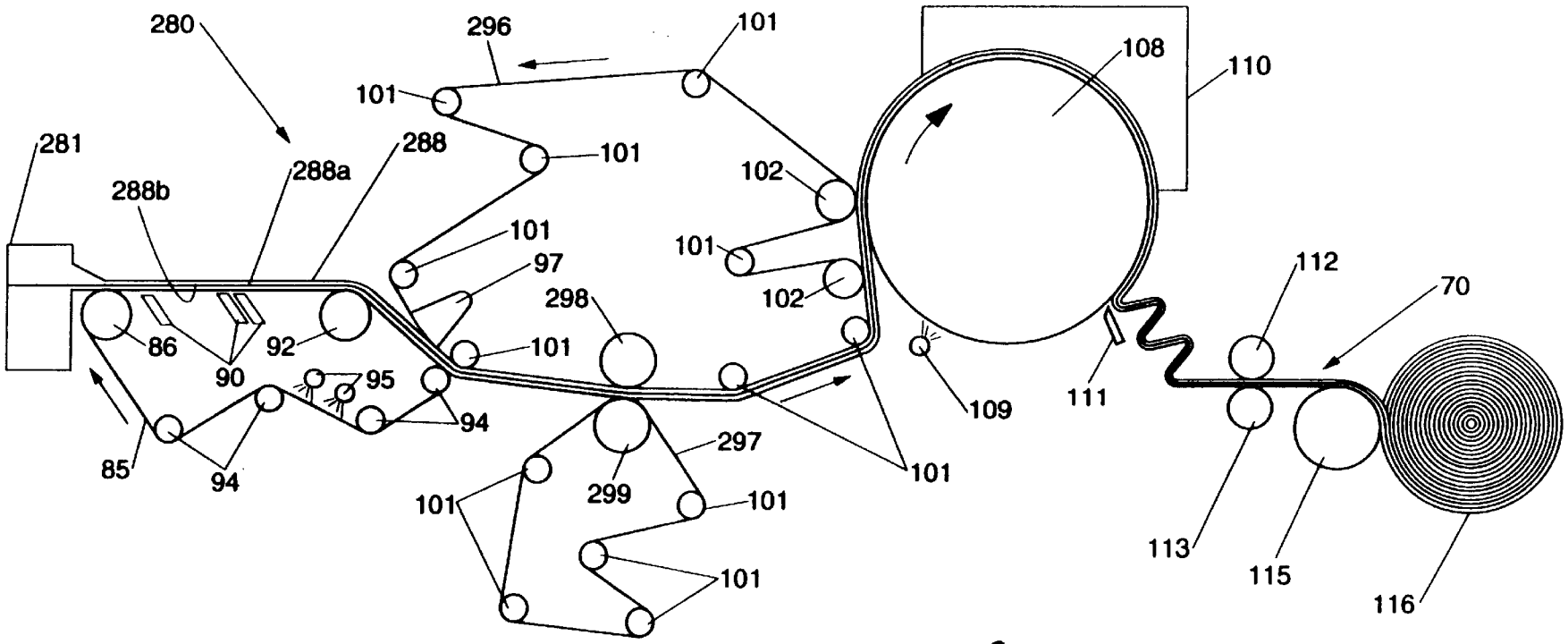
FIG. 2 is a schematic representation illustrating a preferred embodiment of the papermaking process of the present invention for producing a strong and soft creped tissue paper using a conventional drying technique.

FIG. 2 is a side elevational view of an alternate preferred papermaking machine for making tissue sheets by conventional papermaking techniques which were predominate prior to the invention of processes such as those shown in FIG. 1 and described in U.S. Pat. No. 3,301,746, each of which utilizes blow through drying and minimizes compression of the tissue sheet. To simplify description of the alternate preferred papermaking machine of FIG. 2, the components which have counterparts in papermaking machine 80, FIG. 1, are identically designated; and the alternate papermaking machine 280 of FIG. 2 is described with respect to differences therebetween.

Papermaking machine 280 of FIG. 2 is essentially different from papermaking machine 80 of FIG. 1, by virtue of having a duplex headbox 281 comprising a top chamber 282 and a bottom chamber 283 in place of a triple headbox 81; by having a felt loop 296 in place of foraminous carrier fabric 96; by having two pressure rolls 102 rather than one; and by not having blow through dryers 100. Papermaking machine 280, FIG. 2, further comprises a lower felt loop 297 and wet pressing rolls 298 and 299 and means not shown for controllably biasing rolls 298 and 299 together. The lower felt loop 297 is looped about additional turning rolls 101 as illustrated. Papermaking machine 280 is considered a dual felt machine by virtue of having felt loops 296 and 297. Felt loop 297 can be eliminated, in which case papermachine 280 would be considered a single felt machine (not shown). Typically if run as a single felt machine at least one of the pressure roll (102) applies a vacuum to the wet web at the point of transfer to the Yankee dryer (108).

FIG. 2 further shows a two layered embryonic web 288 having layers 288*a* and 288*b* which becomes paper sheet 270 subsequent to drying at the Yankee dryer 108. Paper sheet 270 comprises Yankee side layer 271 and off-Yankee side layer 275.

Optional Ingredients

A. Chemical Softener

Quaternary Ammonium Compound

The tissue paper of the present invention can optionally contain from about 0.005% to about 5.00% by weight, preferably from about 0.03% to about 0.50% by weight of a quaternary ammonium compound having the formula:

$$(R_1)_{4-m}—N^+—[R_2]_m\ X^-$$

wherein m is 1 to 3;

each $R_1$ is a $C_1$–$C_8$ alkyl group, hydroxyalkyl group, hydrocarbyl or substituted hydrocarbyl group, alkoxylated group, benzyl group, or mixtures thereof;

each $R_2$ is a $C_9$–$C_{41}$ alkyl group, hydroxyalkyl group, hydrocarbyl or substituted hydrocarbyl group, alkoxylated group, benzyl group, or mixtures thereof; and $X^-$ is any softener-compatible anion.

Preferably, the majority of $R_2$ comprises fatty acyls containing at least 90% $C_{18}$–$C_{24}$ chain length. More preferably, the majority of $R_2$ is selected from the group consisting of $C_{18}$–$C_{24}$ fatty acyls derived from vegetable oils.

As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swern indicates that typically 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. Preferably, each $R_2$ is C16–C18 alkyl, most preferably each $R_2$ is straight-chain C18 alkyl. Preferably, each $R_1$ is methyl and $X^-$ is chloride or methyl sulfate. Optionally, the $R_2$ substituent can be derived from vegetable oil sources.

Examples of quaternary ammonium compounds suitable for use in the present invention include the well-known dialkyldimethylammonium salts such as ditallow dimethyl ammonium chloride, ditallow dimethylammonium methyl sulfate, di(hydrogenated)tallow dimethyl ammonium chloride; with di(hydrogenated)tallow dimethyl ammonium methyl sulfate being preferred. This particular material is available commercially from Witco Company Inc. of Dublin, Ohio under the tradename "Varisoft® 137".

Biodegradable Ester-Functional Quaternary Ammonium Compound

The tissue paper of the present invention can optionally contain from about 0.005% to about 5.00% by weight, preferably from about 0.03% to about 0.50% by weight, on a dry fiber basis of an biodegradable ester-functional quaternary ammonium compound having the formula:

$$(R)_{4-m}—N^+—[(CH_2)_n—Y—R_2]_m\ X^-$$

wherein each Y=—O—(O)C—, or —C(O)—O—;

m=1 to 3; preferably, m=2;

each n=1 to 4; preferably, n=2;

each R substituent is a short chain $C_1$–$C_6$, preferably $C_1$–$C_3$, alkyl group, e.g., methyl (most preferred), ethyl, propyl, and the like, hydroxyalkyl group, hydrocarbyl group, benzyl group or mixtures thereof;

each $R_2$ is a long chain, preferably at least partially unsaturated (IV of greater than about 5 to less than about 100, more preferably from about 10 to about 85), $C_{11}$–$C_{23}$ hydrocarbyl, or substituted hydrocarbyl substituent and the counter-ion, $X^-$, can be any softener-compatible anion, for example, acetate, chloride, bromide, methylsulfate, formate, sulfate, nitrate and the like.

Preferably, the majority of $R_2$ comprises fatty acyls containing at least 90% $C_{18}$–$C_{24}$ chain length. More preferably, the majority of $R_2$ is selected from the group consisting of $C_{18}$–$C_{24}$ fatty acyls derived from vegetable oils.

The biodegradable ester-functional quaternary ammonium compound prepared with fully saturated acyl groups are rapidly biodegradable and excellent softeners.

Polysiloxane Compound

The tissue paper of the present invention can optionally contain from about 0.005% to about 5.0%, more preferably from about 0.03% to about 0.5% by weight, on a dry fiber basis of a polysiloxane compound having monomeric siloxane units of the following structure:

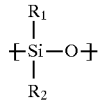

wherein, $R_1$ and $R_2$, for each independent siloxane monomeric unit can each independently be hydrogen or any alkyl, aryl, alkenyl, alkaryl, arakyl, cycloalkyl, halogenated hydrocarbon, or other radical. Any of such radicals can be substituted or unsubstituted. $R_1$ and $R_2$ radicals of any particular monomeric unit may differ from the corresponding functionalities of the next adjoining monomeric unit. Additionally, the polysiloxane can be either a straight chain, a branched chain or have a cyclic structure. The radicals $R_1$ and $R_2$ can additionally independently be other silaceous functionalities such as, but not limited to siloxanes, polysiloxanes, silanes, and polysilanes. The radicals $R_1$ and $R_2$ may contain any of a variety of organic functionalities including, for example, alcohol, carboxylic acid, aldehyde, ketone and amine, amide functionalities. Exemplary alkyl radicals are methyl, ethyl, propyl, butyl, pentyl, hexyl, octyl, decyl, octadecyl, and the like. Exemplary alkenyl radicals are vinyl, allyl, and the like. Exemplary aryl radicals are phenyl, diphenyl, naphthyl, and the like. Exemplary alkaryl radicals are toyl, xylyl, ethylphenyl, and the like. Exemplary arakyl radicals are benzyl, alpha-phenylethyl, beta-phenylethyl, alpha-phenylbutyl, and the like. Exemplary cycloalkyl radicals are cyclobutyl, cyclopentyl, cyclohexyl, and the like. Exemplary halogenated hydrocarbon radicals are chloromethyl, bromoethyl, tetrafluorethyl, fluorethyl, trifluorethyl, trifluorotoyl, hexafluoroxylyl, and the like. References disclosing polysiloxanes include U.S. Pat. No. 2,826,551, issued Mar. 11, 1958 to Geen; U.S. Pat. No. 3,964,500, issued Jun. 22, 1976 to Drakoff; U.S. Pat. No. 4,364,837, issued Dec. 21, 1982, Pader, U.S. Pat. No. 5,059,282, issued Oct. 22, 1991 to Ampulksi et al.; and British Patent No. 849,433, published Sep. 28, 1960 to Woolston. All of these patents are incorporated herein by reference. Also, incorporated herein by reference is *Silicon Compounds*, pp 181–217, distributed by Petrarch Systems, Inc., 1984, which contains an extensive listing and description of polysiloxanes in general.

B. Wet Strength Binder Materials

The present invention contains as an optional component from about 0.01% to about 3.0%, preferably from about 0.01% to about 1.0% by weight of wet strength, either permanent or temporary, binder materials.

Permanent wet strength binder materials

The permanent wet strength binder materials are chosen from the following group of chemicals: polyamide-epichlorohydrin, polyacrylamides, styrene-butadiene latexes; insolubilized polyvinyl alcohol; urea-formaldehyde; polyethyleneimine; chitosan polymers and mixtures thereof. Preferably the permanent wet strength binder materials are selected from the group consisting of polyamide-epichlorohydrin resins, polyacrylamide resins, and mixtures thereof. The permanent wet strength binder materials act to control linting and also to offset the loss in tensile strength, if any, resulting from the chemical softener compositions.

Polyamide-epichlorohydrin resins are cationic wet strength resins which have been found to be of particular utility. Suitable types of such resins are described in U.S. Pat. No. 3,700,623, issued on Oct. 24, 1972, and U.S. Pat. No. 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the trade-mark Kymeme® 557H.

Polyacrylamide resins have also been found to be of utility as wet strength resins. These resins are described in U.S. Pat. No. 3,556,932, issued on Jan. 19, 1971, to Coscia, et al. and U.S. Pat. No. 3,556,933, issued on Jan. 19, 1971, to Williams et al., both patents being incorporated herein by reference. One commercial source of polyacrylamide resins is American Cyanamid Co. of Stanford, Conn., which markets one such resin under the trade-mark Parez® 631 NC.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins may also find utility in the present invention.

Temporary wet strength binder materials

The above-mentioned wet strength additives typically result in paper products with permanent wet strength, i.e., paper which when placed in an aqueous medium retains a substantial portion of its initial wet strength over time. However, permanent wet strength in some types of paper products can be an unnecessary and undesirable property. Paper products such as toilet tissues, etc., are generally disposed of after brief periods of use into septic systems and the like. Clogging of these systems can result if the paper product permanently retains its hydrolysis-resistant strength properties. More recently, manufacturers have added temporary wet strength additives to paper products for which wet strength is sufficient for the intended use, but which then decays upon soaking in water. Decay of the wet strength facilitates flow of the paper product through septic systems. Preferably, the temporary wet strength additives are selected from the group consisting of cationic dialdehyde starch-based resins, dialdehyde starch resins and mixtures thereof.

Examples of suitable temporary wet strength resins include modified starch temporary wet strength agents, such as National Starch 78-0080, marketed by the National Starch and Chemical Corporation (New York, N.Y.). This type of wet strength agent can be made by reacting dimethoxyethyl-N-methyl-chloroacetamide with cationic starch polymers. Modified starch temporary wet strength agents are also described in U.S. Pat. No. 4,675,394, Solarek, et al., issued Jun. 23, 1987, and incorporated herein by reference. Preferred temporary wet strength resins include those described in U.S. Pat. No. 4,981,557, Bjorkquist, issued Jan. 1, 1991, and incorporated herein by reference.

With respect to the classes and specific examples of both permanent and temporary wet strength resins listed above, it should be understood that the resins listed are exemplary in nature and are not meant to limit the scope of this invention.

Mixtures of compatible wet strength resins can also be used in the practice of this invention.

C. Dry strength binder materials

The present invention contains as an optional component from about 0.01% to about 3.0%, preferably from about 0.01% to about 1.0% by weight of a dry strength binder material chosen from the following group of materials: polyacrylamide (such as combinations of Cypro 514 and Accostrength 711 produced by American Cyanamid of Wayne, N.J.); starch (such as Redibond 5320 and 2005) available from National Starch and Chemical Company, Bridgewater, N.J.; polyvinyl alcohol (such as Airvol 540 produced by Air Products Inc of Allentown, Pa.); guar or locust bean gums; and/or carboxymethyl cellulose (such as CMC from Hercules, Inc. of Wilmington, Del.). Preferably, the dry strength binder materials are selected from the group consisting of carboxymethyl cellulose resins, and unmodified starch based resins and mixtures thereof. The dry strength binder materials act to control linting and also to offset the loss in tensile strength, if any, resulting from the chemical softener compositions.

In general, suitable starch for practicing the present invention is characterized by water solubility, and hydrophilicity. Exemplary starch materials include corn starch and potato starch, albeit it is not intended to thereby limit the scope of suitable starch materials; and waxy corn starch that is known industrially as amioca starch is particularly preferred. Amioca starch differs from common corn starch in that it is entirely amylopectin, whereas common corn starch contains both amplopectin and amylose. Various unique characteristics of amioca starch are further described in "Amioca—The Starch from Waxy Corn", H. H. Schopmeyer, Food Industries, December 1945, pp. 106–108 (Vol. pp. 1476–1478). The starch can be in granular or dispersed form albeit granular form is preferred. The starch is preferably sufficiently cooked to induce swelling of the granules. More preferably, the starch granules are swollen, as by cooking, to a point just prior to dispersion of the starch granule. Such highly swollen starch granules shall be referred to as being "fully cooked". The conditions for dispersion in general can vary depending upon the size of the starch granules, the degree of crystallinity of the granules, and the amount of amylose present. Fully cooked amioca starch, for example, can be prepared by heating an aqueous slurry of about 4× consistency of starch granules at about 190° F. (about 88° C.) for between about 30 and about 40 minutes. Other exemplary starch materials which may be used include modified cationic starches such as those modified to have nitrogen containing groups such as amino groups and methylol groups attached to nitrogen, available from National Starch and Chemical Company, (Bridgewater, N.J.). Such modified starch materials are used primarily as a pulp furnish additive to increase wet and/or dry strength. Considering that such modified starch materials are more expensive than unmodified starches, the latter have generally been preferred.

Methods of application include, the same previously described with reference to application of other chemical additives preferably by wet end addition, spraying; and, less preferably, by printing. The binder material may be applied to the tissue paper web alone, simultaneously with, prior to, or subsequent to the addition of the chemical softening composition. At least an effective amount of binder materials, either permanent or temporary wet strength binders, and/or dry strength binders, preferably a combination of a permanent wet strength resin such as Kymene® 557H and a dry strength resin such as CMC is applied to the sheet, to provide lint control and concomitant strength increase upon drying relative to a non-binder treated but otherwise identical sheet. Preferably, between about 0.01% and about 3.0% of binder materials are retained in the dried sheet, calculated on a dry fiber weight basis; and, more preferably, between about 0.1% and about 1.0% of binder materials is retained.

Analytical and Testing Procedures

A. Density

The density of tissue paper, as that term is used herein, is the average density calculated as the basis weight of that paper divided by the caliper, with the appropriate unit conversions incorporated therein to convert to g/cm$^3$. Caliper of the tissue paper, as used herein, is the thickness of the preconditioned (23°+/−1° C., 50+/−2% RH for 24 hours according to a TAPPI Method #T4020M-88) paper when subjected to a compressive load of 95 g/in$^2$ (15.5 g/cm$^2$). The caliper is measured with a Thwing-Albert model 89-II thickness tester (Thwing-Albert Co. of Philadelphia, Pa.). The basis weight of the paper is typically determined on a 4"×4" pad which is 8 plies thick. This pad is preconditioned according to Tappi Method #T402OM-88 and then the weight is measured in units of grams to the nearest ten-thousanths of a gram. Appropriate conversions are made to report the basis weight in units of pounds per 3000 square feet.

B. Measurement of Tissue Paper Lint

The amount of lint generated from a tissue product is determined with a Sutherland Rub Tester. This tester uses a motor to rub a weighted felt 5 times over the stationary toilet tissue. The Hunter Color L value is measured before and after the rub test. The difference between these two Hunter Color L values is calculated as lint.

SAMPLE PREPARATION:

Prior to the lint rub testing, the paper samples to be tested should be conditioned according to Tappi Method #T402OM-88. Here, samples are preconditioned for 24 hours at a relative humidity level of 10 to 35% and within a temperature range of 22° to 40° C. After this preconditioning step, samples should be conditioned for 24 hours at a relative humidity of 48 to 52% and within a temperature range of 22° to 24° C. This rub testing should also take place within the confines of the constant temperature and humidity room.

The Sutherland Rub Tester may be obtained from Testing Machines, Inc. (Amityville, N.Y., 11701). The tissue is first prepared by removing and discarding any product which might have been abraded in handling, e.g. on the outside of the roll. For multi-ply finished product, three sections with each containing two sheets of multi-ply product are removed and set on the bench-top. For single-ply product, six sections with each containing two sheets of single-ply product are removed and set on the bench-top. Each sample is then folded in half such that the crease is running along the cross direction (CD) of the tissue sample. For the multi-ply product, make sure one of the sides facing out is the same side facing out after the sample is folded. In other words, do not tear the plies apart from one another and rub test the sides facing one another on the inside of the product. For the single-ply product, make up 3 samples with the off-Yankee side out and 3 with the Yankee side out. Keep track of which samples are Yankee side out and which are off-Yankee side out.

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.5"×6". Puncture two holes into each of the six cards by forcing the cardboard onto the hold down pins of the Sutherland Rub tester.

If working with single-ply finished product, center and carefully place each of the 2.5"×6" cardboard pieces on top of the six previously folded samples. Make sure the 6" dimension of the cardboard is running parallel to the machine direction (MD) of each of the tissue samples. If working with multi-ply finished product, only three pieces of the 2.5"×6" cardboard will be required. Center and carefully place each of the cardboard pieces on top of the three previously folded samples. Once again, make sure the 6" dimension of the cardboard is running parallel to the machine direction (MD) of each of the tissue samples.

Fold one edge of the exposed portion of tissue sample onto the back of the cardboard. Secure this edge to the cardboard with adhesive tape obtained from 3M Inc. (¾" wide Scotch Brand, St. Paul, Minn.). Carefully grasp the other overhanging tissue edge and snugly fold it over onto the back of the cardboard. While maintaining a snug fit of the paper onto the board, tape this second edge to the back of the cardboard. Repeat this procedure for each sample.

Turn over each sample and tape the cross direction edge of the tissue paper to the cardboard. One half of the adhesive tape should contact the tissue paper while the other half is adhering to the cardboard. Repeat this procedure for each of the samples. If the tissue sample breaks, tears, or becomes frayed at any time during the course of this sample preparation procedure, dicard and make up a new sample with a new tissue sample strip.

If working with multi-ply converted product, there will now be 3 samples on the cardboard. For single-ply finished product, there will now be 3 off-Yankee side out samples on cardboard and 3 Yankee side out samples on cardboard.

FELT PREPARATION:

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.25"×7.25". Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the six pieces of black felt (F-55 or equivalent from New England Gasket, 550 Broad Street, Bristol, Conn. 06010) to the dimensions of 2.25"×8.5"×0.0625". Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snuggly fold over both overhanging felt edges onto the backside of the cardboard with Scotch brand tape. Prepare a total of six of these felt/cardboard combinations.

All samples should be run with the same lot of felt. In fact, if the method is to used in other locations, it is ideal if the same lot of felt can be used. Obviously, there are occasions where a single lot of felt becomes completely depleted. In those cases where a new lot of felt must be obtained, a correction factor must be determined for the new lot of felt. To determine the correction factor, obtain a representative single tissue sample of interest, and enough felt to make up 24 cardboard/felt samples for the new and old lots.

As described below and before any rubbing has taken place, obtain Hunter L readings for each of the 24 cardboard/felt samples of the new and old lots of felt. Calculate the averages for both the 24 cardboard/felt samples of the old lot and the 24 cardboard/felt samples of the new lot.

Next, rub test the 24 cardboard/felt boards of the new lot and the 24 cardboard/felt boards of the old lot as described below. Make sure the same tissue lot number is used for each of the 24 samples for the old and new lots. In addition, sampling of the paper in the preparation of the cardboard/tissue samples must be done so the new lot of felt and the old lot of felt are exposed to as representative as possible of a tissue sample. For the case of 1-ply tissue product, unwind and discard the first 10 sheets of product. Next, obtain 48 strips of toilet tissue each two usable units (also termed sheets) long. Place the first two usable unit strip on the far left of the lab bench and the last of the 48 samples on the far right of the bench. Mark the sample to the far left with the number "1" in a 1 cm by 1 cm area of the corner of the sample. Continue to mark the samples consecutively up to 48 such that the last sample to the far right is numbered 48.

Use the 24 odd numbered samples for the new felt and the 24 even numbered samples for the old felt. Order the odd number samples from lowest to highest. Order the even numbered samples from lowest to highest. Now, mark the lowest number for each set with a letter "Y." Mark the next highest number with the letter "O." Continue marking the samples in this alternating "Y"/"O" pattern. Use the "Y" samples for yankee side out lint analyses and the "O" samples for off-Yankee side lint analyses. For 1-ply product, there are now a total of 24 samples for the new lot of felt and the old lot of felt. Of this 24, twelve are for yankee side out lint analysis and 12 are for off-yankee side lint analysis.

Rub and measure the Hunter Color L values for all 24 samples of the old felt as described below. Record the 12 yankee side Hunter Color L values for the old felt. Average the 12 values. Record the 12 off-yankee side Hunter Color L values for the old felt. Average the 12 values. Subtract the average initial un-rubbed Hunter Color L felt reading from the average Hunter Color L reading for the yankee side rubbed sambles. This is the delta average difference for the yankee side samples. Subtract the average initial un-rubbed Hunter Color L felt reading from the average Hunter Color L reading for the off-yankee side rubbed sambles. This is the delta average difference for the off-yankee side samples. Calculate the sum of the delta average difference for the yankee-side and the delta average difference for the off-yankee side and divide this sum by 2. This is the uncorrected lint value for the old felt. If there is a current felt correction factor for the old felt, add it to the uncorrected lint value for the old felt. This value is the corrected Lint Value for the old felt.

Rub and measure the Hunter Color L values for all 24 samples of the new felt as described below. Record the 12 yankee side Hunter Color L values for the new felt. Average the 12 values. Record the 12 off-yankee side Hunter Color L values for the new felt. Average the 12 values. Subtract the average initial un-rubbed Hunter Color L felt reading from the average Hunter Color L reading for the yankee side rubbed sambles. This is the delta average difference for the yankee side samples. Subtract the average initial un-rubbed Hunter Color L felt reading from the average Hunter Color L reading for the off-yankee side rubbed sambles. This is the delta average difference for the off-yankee side samples. Calculate the sum of the delta average difference for the yankee-side and the delta average difference for the off-yankee side and divide this sum by 2. This is the uncorrected lint value for the new felt.

Take the difference between the corrected Lint Value from the old felt and the uncorrected lint value for the new felt. This difference is the felt correction factor for the new lot of felt.

Adding this felt correction factor to the uncorrected lint value for the new felt should be identical to the corrected Lint Value for the old felt.

The same type procedure is applied to two-ply tissue product with 24 samples run for the old felt and 24 run for the new felt. But, only the consumer used outside layers of the plies are rub tested. As noted above, make sure the samples are prepared such that a representative sample is obtained for the old and new felts.

CARE OF 4 POUND WEIGHT:

The four pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off.

When not in use, the weight must be positioned such that the pads are not supporting the full weight of the weight. It is best to store the weight on its side.

RUB TESTER INSTRUMENT CALIBRATION:

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run 5 strokes by moving the pointer arm on the large dial to the "five" position setting. One stroke is a single and complete forward and reverse motion of the weight. The end of the rubbing block should be in the position closest to the operator at the beginning and at the end of each test.

Prepare a tissue paper on cardboard sample as described above. In addition, prepare a felt on cardboard sample as described above. Both of these samples will be used for calibration of the instrument and will not be used in the acquisition of data for the actual samples.

Place this calibration tissue sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface. Activate the tester by depressing the "push" button.

Keep a count of the number of strokes and observe and make a mental note of the starting and stopping position of the felt covered weight in relationship to the sample. If the total number of strokes is five and if the end of the felt covered weight closest to the operator is over the cardboard of the tissue sample at the beginning and end of this test, the tester is calibrated and ready to use. If the total number of strokes is not five or if the end of the felt covered weight closest to the operator is over the actual paper tissue sample either at the beginning or end of the test, repeat this calibration procedure until 5 strokes are counted the end of the felt covered weight closest to the operator is situated over the cardboard at the both the start and end of the test.

During the actual testing of samples, monitor and observe the stroke count and the starting and stopping point of the felt covered weight. Recalibrate when necessary.

HUNTER COLOR METER CALIBRATION:

Adjust the Hunter Color Difference Meter for the black and white standard plates according to the procedures outlined in the operation manual of the instrument. Also run the stability check for standardization as well as the daily color stability check if this has not been done during the past eight hours. In addition, the zero reflectance must be checked and readjusted if necessary.

Place the white standard plate on the sample stage under the instrument port. Release the sample stage and allow the sample plate to be raised beneath the sample port.

Using the "L-Y", "a-X", and "b-Z" standardizing knobs, adjust the instrument to read the Standard White Plate Values of "L", "a", and "b" when the "L", "a", and "b" push buttons are depressed in turn.

MEASUREMENT OF SAMPLES:

The first step in the measurement of lint is to measure the Hunter color values of the black felt/cardboard samples prior to being rubbed on the toilet tissue. The first step in this measurement is to lower the standard white plate from under the instrument port of the Hunter color instrument. Center a felt covered cardboard, with the arrow pointing to the back of the color meter, on top of the standard plate. Release the sample stage, allowing the felt covered cardboard to be raised under the sample port.

Since the felt width is only slightly larger than the viewing area diameter, make sure the felt completely covers the viewing area. After confirming complete coverage, depress the L push button and wait for the reading to stabilize. Read and record this L value to the nearest 0.1 unit.

If a D25D2A head is in use, lower the felt covered cardboard and plate, rotate the felt covered cardboard 90 degrees so the arrow points to the right side of the meter. Next, release the sample stage and check once more to make sure the viewing area is completely covered with felt. Depress the L push button. Read and record this value to the nearest 0.1 unit. For the D25D2M unit, the recorded value is the Hunter Color L value. For the D25D2A head where a rotated sample reading is also recorded, the Hunter Color L value is the average of the two recorded values.

Measure the Hunter Color L values for all of the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the measurement of the actual tissue paper/cardboard combinations, place the tissue sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over sample, disregard this measurement and recalibrate as directed above in the Sutherland Rub Tester Calibration section.

Remove the weight with the felt covered cardboard. Inspect the tissue sample. If torn, discard the felt and tissue and start over. If the tissue sample is intact, remove the felt covered cardboard from the weight. Determine the Hunter Color L value on the felt covered cardboard as described above for the blank felts. Record the Hunter Color L readings for the felt after rubbing. Rub, measure, and record the Hunter Color L values for all remaining samples.

After all tissues have been measured, remove and discard all felt. Felts strips are not used again. Cardboards are used until they are bent, torn, limp, or no longer have a smooth surface.

CALCULATIONS:

Determine the delta L values by subtracting the average initial L reading found for the unused felts from each of the measured values for the off-Yankee and Yankee sides of the sample. Recall, multi-ply-ply product will only rub one side of the paper. Thus, three delta L values will be obtained for the multi-ply product. Average the three delta L values and subtract the felt factor from this final average. This final result is termed the lint for the fabric side of the 2-ply product.

For the single-ply product where both Yankee side and off-Yankee side measurements are obtained, subtract the average initial L reading found for the unused felts from each of the three Yankee side L readings and each of the three off-Yankee side L readings. Calculate the average delta for the three Yankee side values. Calculate the average delta for the three fabric side values. Subtract the felt factor from each of these averages. The final results are termed a lint for the fabric side and a lint for the Yankee side of the single-ply product. By taking the average of these two values, an ultimate lint is obtained for the entire single-ply product.

Wet lint

A suitable procedure for measuring the wet linting property of tissue samples is described in U.S. Pat. No. 4,950,545; issued to Walter et al., on Aug. 21, 1990, and incorporated herein by reference. The procedure essentially involves passing a tissue sample through two steel rolls, one of which is partially submerged in a water bath. Lint from the tissue sample is transferred to the steel roll which is moistened by the water bath. The continued rotation of the steel roll deposits the lint into the water bath. The lint is recovered and then counted. See col. 5, line 45 - col. 6, line 27 of the Walter et al. patent. Other methods known in the prior art for measuring wet lint also can be used.

C. Measurement of Strength of Tissue Papers

Dry tensile strength

The tensile strength are determined on 10.16 cm wide strips of sample using a Thwing-Albert Intelect II Standard Tensile Tester (Thwing-Albert Instrument Co., 10960 Dutton Rd., Philadelphia, Pa., 19154). This method is intended for use on finished paper products, reel samples, and unconverted stocks.

SAMPLE CONDITIONING AND PREPARATION:

Prior to tensile testing, the paper samples to be tested should be conditioned according to Tappi Method #T402OM-88. All plastic and paper board packaging materials must be carefully removed from the paper samples prior to testing. The paper samples should be conditioned for at least 2 hours at a relative humidity of 48 to 52% and within a temperature range of 22° to 24° C. Sample preparation and all aspects of the tensile testing should also take place within the confines of the constant temperature and humidity room.

For finished product, discard the first 10 usable units (also termed sheets) from the roll. Using scissors, carefully cut four strips of four sheets from the sample roll. Carefully lay the four strips, one on top of the other to form a long stack, keeping the perforations between the sheets coincident. Identify sheet number 2 for machine direction tensile and sheet number 3 for cross direction tensile. Using scissors, cut through the long stack at the line of perforations making four small stacks. Combine stacks 2 and 3 and cut into 10.16 cm×10.16 cm. This makes four samples for machine direction testing and four samples for cross direction testing. Each sample is one sheet thick.

OPERATION OF TENSILE TESTER:

For the actual measurement of the tensile strength, use a Thwing-Albert Intelect II Standard Tensile Tester (Thwing-Albert Instrument Co., 10960 Dutton Rd., Philadelphia, Pa., 19154). Insert the 10.4 cm wide flat face clamps into the unit and calibrate the tester according to the instructions given in the operation manual of the Thwing-Albert Intelect II. Set the instrument crosshead speed to 2.54 cm/min and the 1st and 2nd gauge lengths to 5.08 cm. The break sensitivity should be set to 150.0 grams and the sample width should be set to 10.16 cm and the sample thickness at 1 cm (for calculation purpose only).

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensiles of 125 grams to 375 grams could be tested.

Total Tensile Strength is obtained by measuring the Tensile Strength in the machine direction and cross machine direction and then calculating the geometric mean. Mathematically, this is the square root of the product of the machine direction Tensile Strength (Peak Tensile MD) and the cross direction Tensile Strength (Peak Tensile CD).

$$\text{Total Tensile Strength} = \sqrt{\text{Peak Tensile } MD \times \text{Peak Tensile } CD}$$

Tensile Modulus

Tensile Modulus of tissue samples is obtained at the same time as the tensile strength of the sample is determined. In this method a single ply 10.16 cm wide sample is placed in a tensile tester (Thwing Albert QCII interfaced to an LMS-data system) with a gauge length of 5.08 cm. The sample is elongated at a rate of 2.54 cm/minute. The sample elongation is recorded when the load reaches 10 g/cm, 15 g/cm, and 20 g/cm. A tangent slope is then calculated with the midpoint being the elongation at 15 g/cm.

The Tangent slope is calculated in the following manner $$\text{Tangent slope} = (\text{delta force})/(\text{delta elongation})$$

$$\text{Tensile Modulus 15} = \text{tangent slope} = \frac{(20\text{ g/cm} - 10\text{ g/cm})}{(\%\text{ elongation at 20 g/cm} - \%\text{ elongation at 10 g/cm})}$$

Another exemplerary method for obtaining the tangent slope at 15 g/cm is to use a Thwing-Albert STD tensile tester and setting the load trap to 152.4 grams in the tangent slope calculation program. This is equivalent to 15 g/cm when using the 10.16 cm width sample.

Total Tensile Modulus is obtained by measuring the Tensile Modulus in the machine direction at 15 g/cm and cross machine direction at 15 g/cm and then calculating the geometric mean. Mathematically, this is the square root of the product of the machine direction Tensile Modulus (Tensile Modulus 15 MD) and the cross direction Tensile Modulus (Tensile Modulus 15 CD).

$$\text{Total Tensile Strength} = \sqrt{\text{Ten. Mod. 15 } MD \times \text{Ten. Mod. 15 } CD}$$

High values for Total Tensile Modulus indicate that the sample is stiff and rigid. The Total Tensile Modulus and the Total Tensile Strength are generally related in that Total Tensile Modulus value increase as Total Tensile Strength increases and vice versa. One can evaluate deviations from this relationship by normalizing the Total Tensile Modulus by the Total Tensile Strength. This normalized Total Tensile Modulus is defined as the ATP factor.

$$ATP\text{ factor} = \frac{(\text{Total Tensile Modulus})}{(\text{Total Tensile Strength})}$$

The ATP factor is dimensionless since both the Total Tensile Modulus and the Total Tensile Strength are in units of g/% cm.

D. Slip/Stick Coefficient Measurement

Slip-and-stick coefficient of friction (S&S COF) is defined as the mean deviation of the coefficient of friction. Like the coefficient of friction, it is dimensionless. This test is performed on a KES-4BF surface analyzer with a modified friction probe. The probe sled is a two centimeter diameter, 40 to 60 micron glass frit obtained from Ace Glass Company. The normal force of the probe was 12.5 grams. The details of the procedure are described in "Methods for the Measurement of the Mechanical Properties of Tissue Paper" by Ampulski, et. al., 1991 International Paper Physics Conference, page 19, incorporated herein by reference.

The following example illustrates the practice of the present invention but is not intended to be limiting thereof.

EXAMPLE

The purpose of this example is to illustrate a method using a blow through drying papermaking technique to make soft and absorbent multi-layer creped tissue paper which exhibits the unique combination of physical attributes.

A pilot scale Fourdrinier papermaking machine is used in the practice of the present invention. First, a 3% by weight aqueous slurry of NSK is made up in a conventional re-pulper. A 2% solution of a temporary wet strength resin (i.e., National Starch 78-0080 marketed by National Starch and Chemical Corporation of New York, N.Y.) is added to the NSK stock pipe a rate of 0.3% by weight of the dry fibers. The NSK is diluted to about 0.2% consistency at the fan pump. Second a 3% by weight aqueous slurry of Eucalyptus fibers is made up in a conventional re-pulper. A 2% solution of a dry strength resin (i.e., Redibond® 5320 marketed by National Starch and Chemical Corporation of New York, N.Y.) is added to the Eucalyptus stock pipe at a rate of 0.75% by weight of the dry fibers. A 1% solution of an ester-functional quaternary ammonium compound (as described in Example 1 of U.S. Pat. No. 5,415,737 incorporated herein by reference) is added to the Eucalyptus stock pipe at a rate of 0.4% by weight of the dry fibers. Third, an additional 3% by weight slurry of Eucalyptus fiber is made up in a conventional re-pulper. A 1% solution of the ester-functional quaternary ammonium compound is added to this Eucalyptus stock pipe at a rate of 1% by weight of the dry fibers. This Eucalyptus slurry is diluted to about 0.2% at the fan pump.

The proper furnish components are sent to separate layers in the head box and deposited onto a Foudrinier wire to form a three-layer embryonic web (i.e., each of the two outer layers contains about 25% lightly debonded (0.4% ester-functional quaternary ammonium compound) Eucalyptus fibers and about 15% NSK fibers and the center layer contains about 20% highly debonded (1% ester-functional quaternary ammonium compound) Eucalyptus fibers). Dewatering occurs through the Foudrinier wire and is assisted by a deflector and vacuum boxes. The Fourdrinier wire is of a 5-shed, satin weave configuration having 84 machine-direction and 76 cross-machine-direction monofilaments per inch, respectively. The embryonic wet web is transferred from the Foudrinier wire, at a fiber consistency of about 15% at the point of transfer, to a 5-shed fabric, satin weave configuration having 59 machine-direction and 44 cross-machine-direction monofilaments per inch, respectively. Further de-watering is accomplished by vacuum assisted drainage until the web has a fiber consistency of about 28%. The patterned web is pre-dried by air blow-through to a fiber consistency of about 65% by weight. The web is then adhered to the surface of a Yankee dryer with a sprayed creping adhesive comprising 0.25% aqueous solution of Polyvinyl Alcohol (PVA). The fiber consistency is increased to an estimated 96% before the dry creping the web with a doctor blade. The doctor blade has a bevel angle of about 25 degrees and is positioned with respect to the Yankee dryer to provide an impact angle of about 81 degrees; the Yankee dryer is operated at about 800 fpm (feet per minute) (about 244 meters per minute). The dry web is formed into roll at a speed of 700 fpm (214 meters per minutes).

The web is converted into a one-ply tissue paper product. Importantly, the tissue paper having a ATP factor of less than about 0.026, a slip/stick coefficient of about 0.022, and a lint level of about 2.1 and is suitable for use as facial and/or toilet tissues.

What is claimed is:

1. A soft absorbent, creped tissue paper, wherein said tissue paper contains a sufficient amount of a chemical softener and binder materials to achieve an ATP factor of less than about 0.036, a slip/stick coefficient of less than about 0.024, and a lint level of less than about 5, wherein said chemical softener consists of a quaternary ammonium compound.

2. The tissue paper of claim 1 wherein said tissue paper has a density of less than about 0.15 gram/cm$^3$.

3. The tissue paper of claim 1 wherein said tissue paper is a single-ply tissue.

4. The tissue paper of claim 1 wherein said tissue paper is a multi-layer tissue.

5. The tissue paper of claim 1 wherein said tissue paper is made by a through air drying technique.

6. The tissue paper of claim 1 wherein said ATP factor of less than about 0.030.

7. The tissue paper of claim 6 wherein said slip/stick coefficient is less than about 0.022.

8. The tissue paper of claim 7 wherein said tissue paper has a density of less than about 0.10 gram/cm$^3$.

9. The tissue paper of claim 8 wherein said tissue paper is a single-ply tissue.

10. The tissue paper of claim 8 wherein said tissue paper is a multi-layer tissue.

11. The tissue paper of claim 8 wherein said tissue paper is made by a through air drying technique.

12. The tissue paper of claim 8 wherein said tissue paper comprises a mixture of softwood and hardwood fibers.

13. The tissue paper of claim 12 wherein said binder materials are permanent wet strength binders selected from the group consisting of polyamide-epichlorohydrin resins, polyacrylamide resins, and mixtures thereof.

14. The tissue paper of claim 12 wherein said binder materials are temporary wet strength binders selected from the group consisting of cationic dialdehyde starch-based resins, dialdehyde starch resins and mixtures thereof.

15. The tissue paper of claim 12 wherein said binder materials are dry strength binders selected from the group consisting of carboxymethyl cellulose resins, starch based resins, and mixtures thereof.

16. The tissue paper of claim 1 wherein said tissue paper is made by a mechanical dewatering technique.

17. The tissue paper of claim 16 wherein said tissue paper is a single-ply tissue.

18. The tissue paper of claim 16 wherein said tissue paper is a multi-ply tissue.

19. The tissue paper of claim 16 wherein said tissue paper is a multi-layer tissue paper.

20. The tissue paper of claim 16 wherein said tissue paper has a density of less than about 0.15 gram/cm$^3$.

21. The tissue paper of claim 1 wherein said tissue paper is toilet tissue paper.

22. The tissue paper of claim 1 wherein said tissue paper is facial tissue paper.

23. The tissue paper of claim 1 wherein said quaternary ammonium compound has the formula:

$$(R_1)_{4-m}—N^+—[R_2]_m\ X^-$$

wherein m is 1 to 3;

each $R_1$ is a $C_1$–$C_8$ alkyl group, hydroxyalkyl group, hydrocarbyl or substituted hydrocarbyl group, alkoxylated group, benzyl group, or mixtures thereof;

each $R_2$ is a $C_9$–$C_{41}$ alkyl group, hydroxyalkyl group, hydrocarbyl or substituted hydrocarbyl group, alkoxylated group, benzyl group, or mixtures thereof; and $X^-$ is any softener-compatible anion.

24. The tissue paper of claim 1 wherein said quaternary ammonium compound is a biodegradable ester-functional quaternary ammonium compound having the formula:

$$(R)_{4-m}—N^+—[(CH_2)_n—Y—R_2]_m\ X^-$$

wherein each Y=—O—(O)C—, or —C(O)—O—;

m=1 to 3;

each n=1 to 4;

each R substituent is a short chain $C_1$–$C_6$ alkyl group, hydroxyalkyl group, hydrocarbyl group, benzyl group or mixtures thereof;

each $R_2$ is a long chain, $C_{11}$–$C_{23}$ hydrocarbyl, or substituted hydrocarbyl substituent; and $X^-$ is any softener-compatible anion.

* * * * *